US008822804B1

(12) United States Patent
Vassilev

(10) Patent No.: US 8,822,804 B1
(45) Date of Patent: Sep. 2, 2014

(54) DIGITAL AEROPHONES AND DYNAMIC IMPULSE RESPONSE SYSTEMS

(71) Applicant: Vladimir Vassilev, Oslo (NO)

(72) Inventor: Vladimir Vassilev, Oslo (NO)

(73) Assignee: Vladimir Vassilev, Oslo (NO)

( * ) Notice: Subject to any disclaimer, the term of this patent is extended or adjusted under 35 U.S.C. 154(b) by 0 days.

(21) Appl. No.: 13/763,627

(22) Filed: Feb. 9, 2013

(51) Int. Cl.
*G10H 7/00* (2006.01)

(52) U.S. Cl.
USPC ..... 84/723; 84/742

(58) Field of Classification Search
USPC ..... 84/600–602, 622, 659, 615, 653, 723, 84/742
See application file for complete search history.

(56) References Cited

U.S. PATENT DOCUMENTS

| | | | | |
|---|---|---|---|---|
| 5,500,486 | A * | 3/1996 | Smith, III | 84/622 |
| 5,508,473 | A * | 4/1996 | Chafe | 84/659 |
| 5,578,780 | A * | 11/1996 | Wachi | 84/659 |
| 5,641,931 | A * | 6/1997 | Ogai et al. | 84/661 |
| 5,777,255 | A * | 7/1998 | Smith et al. | 84/661 |
| 5,998,723 | A * | 12/1999 | Suzuki | 84/622 |
| 6,031,173 | A * | 2/2000 | Ikeda et al. | 84/605 |
| 6,284,965 | B1 * | 9/2001 | Smith et al. | 84/661 |
| 6,751,322 | B1 * | 6/2004 | Carlbom et al. | 381/63 |
| 7,369,663 | B2 * | 5/2008 | Sekine | 381/63 |
| 7,442,869 | B2 * | 10/2008 | Zinato | 84/620 |
| 7,534,953 | B2 * | 5/2009 | Kergomard et al. | 84/659 |
| 7,772,481 | B2 * | 8/2010 | Aimi | 84/723 |
| 7,860,256 | B1 * | 12/2010 | Diedrichsen | 381/63 |
| 7,935,881 | B2 * | 5/2011 | Aimi | 84/734 |
| 2003/0159569 | A1 * | 8/2003 | Ohta | 84/630 |
| 2005/0257671 | A1 * | 11/2005 | Aimi | 84/735 |
| 2006/0065108 | A1 * | 3/2006 | Kergomard et al. | 84/659 |
| 2006/0201312 | A1 * | 9/2006 | Zinato | 84/622 |
| 2007/0227344 | A1 * | 10/2007 | Ryle et al. | 84/723 |
| 2007/0237335 | A1 * | 10/2007 | O'Sullivan | 381/63 |
| 2008/0034946 | A1 * | 2/2008 | Aimi | 84/604 |
| 2009/0266219 | A1 * | 10/2009 | Nakae | 84/229 |

OTHER PUBLICATIONS http://www.music.mcgill.ca/caml/lib/exe/fetch.php?media=publications:ma_buckiewicz-smith_2008.pdf 2008. Viewed Mar. 8, 2014.*

* cited by examiner

*Primary Examiner* — David S. Warren

(57) ABSTRACT

Method and apparatus for playing existing aerophone musical instruments e.g. bagpipe or constructing new instruments or more general human interaction devices by continuous estimation of the impulse response of the acoustic system of the instrument with the use of probing signal. In the proposed apparatus this is done by means of transducers introducing probing signal and capturing and analyzing the signal resulting from the interaction between the probing signal, the instrument and the player. In contrast to the normal way aerophone instruments are used where a player blows air and stimulates vibration of air this method does not require the player to blow, the generated probing signal can be outside of the audiable sound range and the output of the instrument can be outputted as digital data.

3 Claims, 2 Drawing Sheets

DIGITAL AEROPHONES AND DYNAMIC IMPULSE RESPONSE SYSTEMS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The field of the invention is music instruments and human interaction devices

An aerophone is any musical instrument which produces sound primarily by causing a body of air to vibrate, without the use of strings or membranes, and without the vibration of the instrument itself adding considerably to the sound. It is one of the four main classes of instruments in the original Hornbostel-Sachs scheme of musical instrument classification. The traditional way of playing aerophone instruments is to create airflow and dynamically modify certain properties of the instrument which cause its air column to vibrate at different resonant frequencies. As a result of that the instrument produces its output in the form of periodic acoustic waveform with different frequencies. The airflow produced can be both constant as in bagpipes or dynamic as in flute or clarinet.

The method proposed in this invention aims at providing alternative for using aerophone instruments without creating airflow and without generating acoustic output directly from the instrument.

There are known methods for achieving that. A common method for producing electronic practice instruments is to install buttons inside the finger holes of the instrument. This solution is acceptable only for very basic practice instruments since it can not reproduce the complex characteristics of the real instrument.

The disclosed embodiments take a different approach and describe method based on continuous estimation of the impulse response function of the acoustic system of the instrument and mathematical model that is used to produce the output signal of the instrument.

The generality of such method allows for it to be used not only in music instruments but also in other applications as in human interaction devices where the state of the acoustic system of an object the user interacts with can be identified and used as input.

The proposed method combines ideas from the fields of signal processing and acoustics.

BRIEF SUMMARY OF THE INVENTION

The disclosed invention provides a method for playing aerophone instruments based on dynamic estimation of the impulse response of the acoustic system of the instrument. The method is based on the assumption that a real aerophone instrument in its acoustic resonator system appears close enough in its characteristics to a corresponding linear acoustic system model and that the mathematical methods applicable for such linear system produce acceptable results with real aerophone instruments. In addition to its linearity the proposed method assumes that the system can be reviewed as time-invariant for time intervals that are short enough. A disclosed method for dynamic system identification for such system is used to estimate the finite impulse response of the system.

Having estimated the impulse response of the linear time-invariant system it is possible to determine the output signal for any input signal applied by simple convolution which allows the integration of such dynamic linear system in variety of system models.

Alternative method is disclosed for using the dynamically estimated impulse responses by determining a discrete output value from a set of predefined impulse responses with corresponding values using the least sum of squares of differences.

The invention extends to apparatus comprising:

probe signal generator transducer transmitting the probe signal as acoustic signal transducer receiving the resulting signal from the interaction of the probing signal and the current state of the acoustic system of the aerophone processing block estimating the impulse response processing block estimating the output signal as a function of the impulse response and the input signal

DETAILED DESCRIPTION OF THE INVENTION

The instruments from the aerophones class have pertaining acoustic systems with properties like the air column dimensions the player changes dynamically. The majority of the instruments can be modeled with the exciter-resonator interaction scheme FIG. 6 which is prior art.

Figure 6:
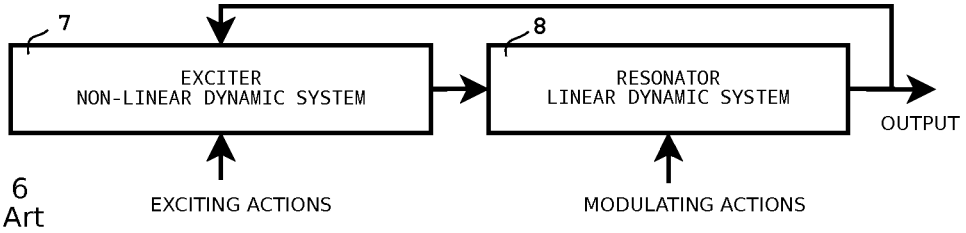
FIG. 6 Prior Art
FIG. 6 is a prior art exciter-resonator interaction scheme for a musical instrument
Figure 7:
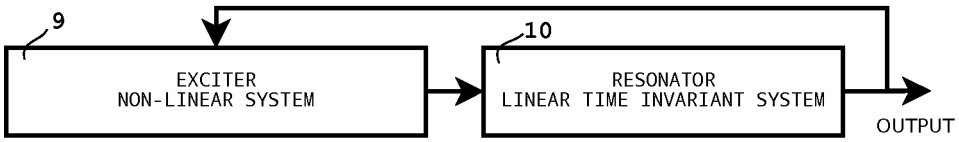
FIG. 7 is an exciter-resonator scheme for a musical instrument for period short enough so that the modulating and exciting interaction effects can be ignored and the exciter and resonator systems assumed invariant.

The effect of the modulating actions can be assumed neglectable in short enough time interval and for that time interval the exciter-resonator interaction scheme from FIG. 6 can be replaced with the time-invariant system from FIG. 7. Such discretization of the player interaction simplifies the model of the resonator to a linear time-invariant system. This is illustrated with the conversion of 7 representing the exciter as non-linear dynamic system which is dependent on the exciting actions to 9 where the exciter is still a non-linear system but no longer depends on the exciting actions of the user. Similarly the effects of discretization of the player actions result in the transformation of the resonator 8 which is linear dynamic system affected by the modulating actions of the user to linear time invariant system 10.

The simplest model of a resonator can contain one input signal representing the acoustic pressure added to a point part of the acoustic system and one output signal representing the acoustic pressure detected in a point part of the acoustic system. If any two points part of that acoustic system are selected and referred to as A and B and a source of acoustic signal such as speaker is introduced in point A and sensor of acoustic signal such as microphone is introduced in point B there is a certain function describing the relationship between the generated acoustic signal in A which can be referred to as input and the measured signal in B which can be referred to as output. This function is changing dynamically with relevance to the changes of the acoustic properties of the system introduced by the player. If this dynamic function is reviewed in short enough intervals it can be modeled with certain degree of accuracy with a linear time-invariant system. It is known fact that any linear time-invariant system can be completely described by its impulse response function. There are variety of methods used to estimate the impulse response function of a linear time-invariant system also referred to as system identification by introducing known signal to the input and analyzing the output signal. The proposed digital signal processing algorithm can be logically divided into two parts. Part one functions by periodically estimating the impulse response of the system with input at point A and output at point B. The estimated impulse response in each period is taken as argument by the second part of the algorithm which synthesizes the output of the instrument. The estimation of the impulse response and the synthesis of the output should be done with rate high enough so that the quantization effect introduced is not significant.

A solution for the task of the first part of the algorithm can be achieved with time-domain correlation analysis. Time-domain correlation analysis is a nonparametric estimate of transient response of dynamic systems, which computes a finite impulse response model from the data. Correlation analysis assumes a linear system and does not require a specific model structure. Correlation analysis of the known input signal and the detected output can be performed in real time. The following formula known as input-output crosscorrelation function is considered the base of correlation analysis:

$$r_{yx}(m) = \sum_{k=0}^{\infty} h(k) r_{xx}(m-k) = h(k) * r_{xx}(m). \quad (1)$$

According to the formula the correlation of the known input signal with the detected output signal gives the impulse response function of the linear time-invariant system convolved with the autocorrelation function of the input signal. Input signals which have autocorrelation equivalent to the delta function will have a correlation with the output equal to the impulse response of the linear time-invariant system. For example the delta function is a perfect candidate. However producing a single sample impulse signal containing all the energy has a number of disadvantages and is not practical. Another option is an infinite sequence of random values which also has delta function as its autocorrelation. However since we want to be able to estimate the impulse response periodically the signal has to be shorter then the desired period. A simple and working solution is to use a linear chirp signal of length equal to the desired update period. For sufficient length of the chirp the autocorrelation function is very similar to the delta function so the correlation of the input and output signals contained in one period yields function very similar to the impulse response of the analyzed system.

For the implementation of the second part of the proposed method this invention proposes two alternatives for implementing the function which takes the periodically calculated impulse response functions as parameter and synthesizes the output signal.

In the first method a predefined set of impulse responses corresponding to known states is used to compare with the estimated impulse response. The predefined set of impulse responses can be composed either analytically or experimentally. With the analytical approach a correct mathematical model of the acoustic system is required while the experimental approach can be used with any instrument which allows the user to simply go through a sequence of the dynamic states and build such a set for any acoustic system the acoustic probe apparatus can be installed in. The detection process is based on the minimum squares of the differences with each of the prerecorded impulse responses. The produced sound is synthesized from function that takes as input the index of the best matching impulse response from enumeration of all predefined states. The function uses a set of data containing the characteristics of the signal to be produced for each state. For a very simple implementation of such function the data set can contain only the frequency of the signal and the function can output sine signal with frequency corresponding to the detected state.

A modified version of the synthesis function based on this method can alternatively generate discrete tokens when change in state is detected instead of audio signal. In this mode the device can be used as general human interaction device similar to keyboard or digital equipment which captures events and adjustments to controls with interface like MIDI.

In the second and most general method the periodically estimated finite impulse responses are used in convolution with the input signal from the non-linear system of the exciter block in order to generate the output signal. In this method every single sample of the produced output signal is produced by realistic physical model of the system instead of being a function of the closest recognized state and thus the closest emulation of playing aerophone instrument can be achieved. With this method all advanced techniques used by the player will produce a comparable output signal to the original instrument modeled by the system. This method can be generalized and used with any interaction signal system generating the interaction signal with at least one subsystem of dynamic linear type with impulse response equal to the dynamically estimated impulse response of a dynamic acoustic system the human interacts with.

Figure 1:
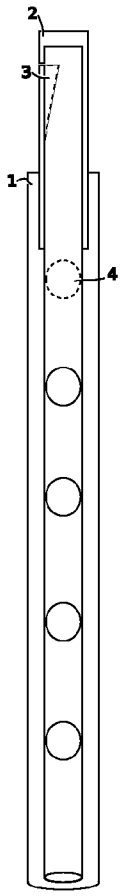
FIG. 1 is a frontal view of a generalized aerophone resembling the chanter of a bagpipe

Based on the methods proposed in the invention a working example is described below:

In FIG. 1 an authentic aerophone instrument is presented. The chosen instrument resembles the chanter 1 of bagpipe which has a reed 2 with vibrating piece 3 as source of acoustic vibration. The player of the instrument closes or opens the holes and by doing so changes the properties of the air column of the instrument. For example when all the holes including the first one 4 are open the instrument produces its highest frequency. This happens because the air column is shortest and the reed resonates at frequency with corresponding acoustic wavelength.

Figure 2:
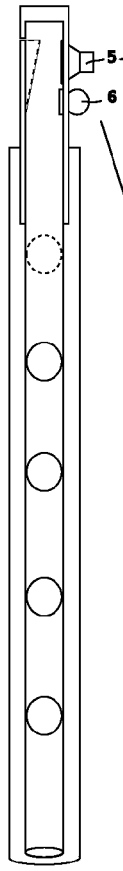
FIG. 2 is a frontal view of a generalized aerophone resembling the chanter of a bagpipe instrumented with acoustic probe
Figure 3:
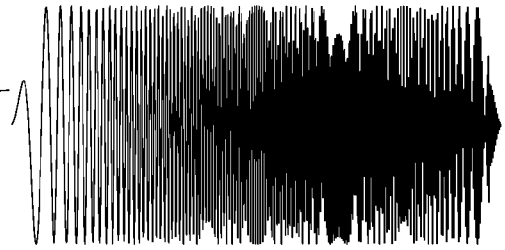
FIG. 3 is a graph of a linear chirp signal sent as a probing signal
Figure 4:
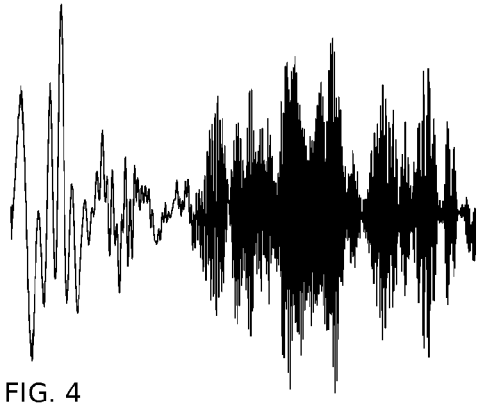
FIG. 4 is a graph of experimental signal received back as a result of the probing signal from FIG. 3
Figure 5:
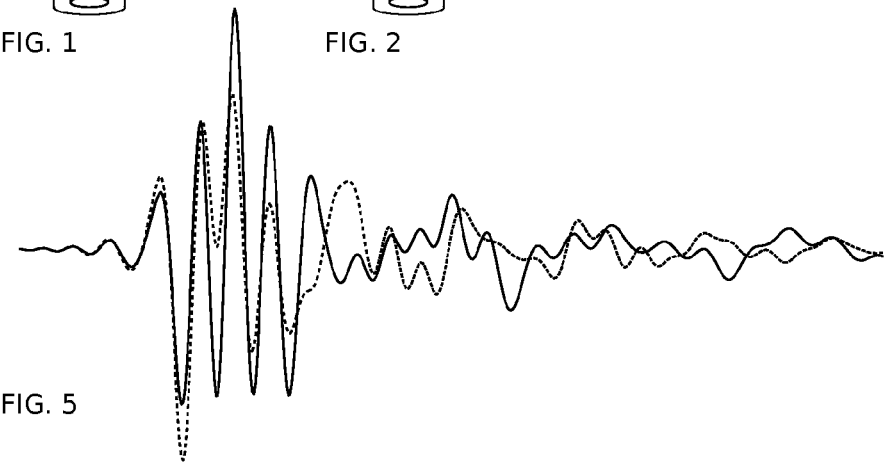
FIG. 5 is a graph of the correlation of the probing signal and the resulting signal in two different states of the aerophone

In FIG. 2 the normal reed is replaced with one instrumented with acoustic probe. The probe consists of speaker 5 and microphone 6. More complex aerophones may require several speakers and microphones. The speaker is driven by a test signal. The signal waveform in FIG. 3 is one period of periodic signal consisting of linear chirps. The signal detected by the microphone is shown in FIG. 4. This signal is a superposition of the direct path signal and all echoes taking place inside the acoustic system of the instrument. Correlating the signal played with the signal detected with the microphone yields the impulse response function of the acoustic system in its current state. In FIG. 5 the continuous line represents the impulse response of the instrument when its first hole 4 is closed and the rest are open. The dashed line represents the impulse response when all holes are open. For better visualization the two impulse response functions have been low-pass filtered. It should be noted that the number of states defined is not limited by the number of holes in the sense that different distances of the finger from the hole can be considered different state.

The visualized speaker signal and the recording of microphone signal was done on a prototype system using audio signal generated form a computer equipped with analog to digital converter sampling at 96000 Hz. The targeted update rate of the impulse response was 100 Hz and the periodic chirp frame and the microphone frame correlated were 960 samples long. The number of correlation lags calculated was 240. It was chosen to be at least twice the sample times needed for the sound to travel from the speaker to the furthest point part of the aerophone acoustic system and back to the microphone. Larger then 2*samples_per_second*length_of_chanter/speed_of_sound=2*96000*0.4/340=225.8824

The system was in addition tested successfully with chirp signals containing only frequencies above the 16000 Hz audible range. Using band limited speaker signals affects the quality of the impulse response estimation since the autocorrelation function of a band limited signal differs more significantly form the delta function than the one of a band unlimited signal using the same amount of samples. However the impulse response functions convolved with that imperfect delta function are still usable despite the effect.

What is claimed is:

1. A method for determining the dynamic impulse response of an aerophone, the method comprising:

determining an approximation of an impulse response of one or more acoustic channels within the aerophone, selecting a closest match of the approximation of a current impulse response to a set of predefined or prerecorded impulse responses, and generating an output signal based on the selection, wherein the output signal is created without airflow and without generating acoustic output directly from the instrument.

2. A method as in claim 1, where the selection of the closest match is based on comparing a least sum of squares of differences with the predefined or prerecorded impulse responses corresponding to each of the states in the set.

3. An apparatus for generating an output signal corresponding to the dynamic state of an aerophone comprising:

a means for determining an approximation of an impulse response of one or more acoustic channels within the aerophone, a means for selecting a closest match of the approximation of a current impulse response to a set of predefined or prerecorded impulse responses, and a means for generating an output signal based on the selection, wherein the output signal is created without airflow and without generating acoustic output directly from the instrument.

* * * * *